United States Patent [19]

Schoendorfer

[11] 4,402,680

[45] Sep. 6, 1983

[54] APPARATUS AND METHOD FOR SEPARATING FLUID INTO COMPONENTS THEREOF

[75] Inventor: Donald W. Schoendorfer, Brookline, Mass.

[73] Assignee: Haemonetics Corporation, Braintree, Mass.

[21] Appl. No.: 281,649

[22] Filed: Jul. 9, 1981

[51] Int. Cl.[3] ..... B04B 5/02

[52] U.S. Cl. ..... 494/3; 494/17; 494/37

[58] Field of Search ..... 494/1, 2, 3, 4, 5, 6, 494/10, 27, 85, 37; 604/6, 131; 210/104, 112, 113, 115, 119

[56] References Cited

U.S. PATENT DOCUMENTS

| | | | |
|---|---|---|---|
| 2,712,897 | 7/1955 | Kusserow et al. | 233/28 |
| 2,850,211 | 9/1958 | Fernandez | 222/67 |
| 3,623,658 | 11/1971 | Garbaty | 233/20 |
| 3,648,697 | 3/1972 | Gardner | 128/272 |
| 3,674,197 | 7/1972 | Mitchell | 494/17 |
| 3,679,128 | 7/1972 | Unger | 494/32 |
| 3,749,304 | 7/1973 | Putterlik | 233/47 |
| 3,888,410 | 6/1975 | McKee | 233/6 |
| 3,908,893 | 9/1975 | Williams | 233/20 |
| 3,987,961 | 10/1976 | Sinn | 494/10 |
| 3,989,536 | 11/1976 | Werner | 127/19 |
| 4,120,448 | 10/1978 | Cullis . | |

*Primary Examiner*—Robert W. Jenkins

*Attorney, Agent, or Firm*—Hamilton, Brook, Smith and Reynolds

[57] ABSTRACT

An improved method and apparatus are disclosed for sealing the outlet port of a flexible blood-processing bag after a separated first blood component has been expressed therefrom. The improvements relate to the use of a valve contained within the flexible blood-processing bag and responsive to the difference in specific gravities between first blood component and second blood component. For example, the valve may comprise a stopper ball having a specific gravity which allows it to float at the interface between first and second blood component.

25 Claims, 11 Drawing Figures

APPARATUS AND METHOD FOR SEPARATING FLUID INTO COMPONENTS THEREOF

DESCRIPTION

Technical Field

This invention is in the field of fluid processing and more particularly relates to the centrifugal separation of fluid, such as blood, into two or more components.

Background Art

The desirability and/or necessity of separating whole blood into its components is gaining wide recognition. For example, it has been pointed out that limiting a transfusion to only those blood components necessary for a particular purpose preserves the available supply of blood, and in many situations is better for the patient. Additionally, in many therapeutic techniques, it is necessary to separate one blood component and to reinfuse that component after it has been processed or to substitute the same component from another source.

A copending U.S. patent application Ser. No. 5126, now U.S. Pat. No. 4,303,193, to Allen Latham, Jr. filed Jan. 22, 1979, describes a centrifuge (hereinafter the Latham centrifuge) for separating one or more components of blood into precise fractions. Such centrifuges operate under the principle that fluid components having different densities or sedimentary rates may be separated in accordance with such densities or sedimentary rates by subjecting the fluid to a centrifugal field.

In the Latham centrifuge, a flexible, disposable blood processing bag is mounted within the rotor of a self-balancing centrifuge rotor in a contoured processing chamber consisting of a pair of support shoes. The contoured chamber is designed to support the blood bag in a position whereby separated blood components traverse a short distance in the process of separation. A flexible displacer bag is employed as a movable diaphragm to apply pressure to the disposable blood bag in response to the introduction of displacement fluid into the displacer bag while the centrifuge rotor is either rotating or stationary. Such pressure tends to expel separated blood components from the disposable blood bag.

In a typical embodiment of the Latham centrifuge, the flexible blood processing and displacer bags are located radially outward from a centrally located collection chamber. The pressure required to expel blood components from the processing bag is given by the formula: $p=\frac{1}{2}(r_0^2-r_1^2)\rho w^2$ wherein $r_0$ is the radial distance from the center of rotation to the blood bag and $r_1$ is the radial distance from the center of rotation to the point of collection and w is the rate of rotation. for a 5.45 inch rotor radius and a 2 inch collection point radius with the centrifuge rotating at a speed of 2000 r.p.m. and an average blood component density of 1.05 $gm/_{cm}3$, a pressure of 55 psi must be generated by the displacer fluid to expel blood components from the processing bag into the collection chamber. In a typical application, where the blood processing bag is 6 inches by 10 inches, this force can amount to 3320 pounds and the generation of such large forces tends to move or push the contoured shoes apart.

Copending U.S. patent application Ser. No. 159,932, now U.S. Pat. No. 4,304,357, to Donald W. Schoendorfer filed June 16, 1980 relates to an improvement in the Latham centrifuge whereby a weight, or pressure, plate (hereinafter the Schoendorfer pressure plate) is provided adjacent the inner wall of the support shoe nearest the center of rotation of the rotor. The mass of this pressure plate is chosen to at least equalize the inner pressure generated by the processing bags under the influence of centrifugal force. The pressure plate serves to maintain the contoured shoes securely against the blood processing bags.

Nevertheless, while the Latham centrifuge as modified by the Schoendorfer pressure plate operates satisfactorily for the purpose intended, a number of improvements are desirable to make the apparatus less complex, more flexible in application, and lower in cost.

For example, the requirement for a contoured shoe limits the volume of the blood processing bag to a size that will fit into the contours of the shoe.

Also, the necessity for introducing a displacer fluid creates additional complexity. It becomes necessary to either introduce a displacer fluid from an external source, as in the Latham centrifuge, or to provide a reservoir of displacer fluid on the rotor as in copending U.S. patent application Ser. No. 205144 filed Nov. 10, 1980, now U.S. Pat. No. 4,381,627, to Donald W. Schoendorfer.

Additionally, in order to have blood processing bags which are disposable, the cost of fabricating the bags should be kept to a minimum. On the other hand, the bags must not rupture under the tremendous forces they are subjected to during the centrifuge process. If these forces are minimized, the bags can be constructed of low-cost materials.

Furthermore, the elimination of an external control over the displacement of fluid creates the concomitant problem as to how flow of components from one bag to another may be conveniently terminated at the right moment for establishing prime fractionation.

A need therefore exists for a blood processing centrifuge apparatus which is capable of handling different volumes of whole blood, does not require a supply of displacer fluid, minimizes the pressure to which the blood processing bags are subjected and provides for automatic termination of flow once a desired quantity of component has been expelled.

DISCLOSURE OF THE INVENTION

This invention relates to the method of separating blood in a centrifuge as disclosed in the copending U.S. patent application Ser. No. 281,648, filed July 9, 1981, to Schoendorfer and Avery (hereinafter "Self-Balancing Centrifuge") wherein blood is separated in a flexible blood-processing bag into first and second blood components. In its broadest sense, this invention relates to the improvement of sealing the outlet port of the flexble blood-processing bag by a valve within the blood-processing bag after a predetermined quantity of first blood component has been expelled therefrom. This valve has a stopper with a specific gravity which allows it to float on the interface between first and second blood components. Thus, the specific gravity of the stopper is greater than the specific gravity of first blood component but less than the specific gravity of second blood component. Because of this, the stopper approaches the outlet port of the flexible disposable processing bag at the interface between first and second blood blood components and eventually seals the outlet port after a predetermined quantity of first blood component has been expelled therefrom.

In a preferred embodiment, the stopper is provided in a disposable software set designed for use in a Self-Balancing Centrifuge. The software consists of a flexible blood-processing bag having an inlet port and an outlet port and being suitable for mounting in the processing chamber of a Self-Balancing Centrifuge. Blood compatible tubing extends between the inlet port of the blood-processing bag and a connector to a source of blood to be separated. Such a source of blood might be a human donor, in which case the connection means might be a phlebotomy needle, or the source may be a bag containing whole blood, in which case the connection means might be a bag spike.

The disposable software also includes a receiver container for first blood component which is expelled from the processing bag. The receiver container is connected to the outlet port of the flexible blood-processing bag so that expelled first blood component can be directed into the receiver container.

According to this invention, the flexible blood-processing bag also contains valve means for sealing its outlet port in response to the difference between the specific gravities of separated first and second blood components. An example of a suitable means for sealing is a valve with a stopper which has a specific gravity which is higher than the specific gravity of first blood component but lower than the specific gravity of second blood component. The stopper may be a free-floating ball, a ball contained within guide channels, a flap attached at one end to an interior surface of the blood-processing bag adjacent to its outlet port, or other similar stoppers.

Thus, there is provided by this invention a simple but expedient means for providing a precise cut between blood components. The valve described herein operates in a fully automatic way depending only on the difference in specific gravities between the separated components. The valve is versatile in the sense that it can be adapted to provide a precise cut between any number of different blood components based upon their specific gravity difference. Furthermore, the precise cut can also be adjusted by changing the size of the stopper, e.g., providing a large or small diameter ball, or by changing its shape. Additionally, the use of such a stopper eliminates the extreme precision required in the geometry and weight of a pressure plate if a precise cut in blood components is to be made. Finally, the stopper of this invention can be made an integral part of the software supplied for use in any particular blood separation.

Additionally, the valve may be made intentionally leaky so that the stopper is unseated and additional separation may be made by re-cycling the valve.

These and other advantages will become apparent from the following description.

BEST MODE FOR CARRYING OUT THE INVENTION

As used herein, the following terms are defined to mean:

"First blood component"—one fraction of blood which it is desired to separate from another fraction;

"Second blood component"—another fraction separated from blood which is the balance after first blood component has been separated therefrom;

"Platelet-rich plasma" or "PRP"—a fraction of plasma which is rich in platelets;

"Platelet-poor plasma" or "PPP"—a fraction of plasma which is poor in platelets;

"Packed red blood cells" or "RBC"—a fraction of blood which is rich in red blood cells.

In general, it may be seen that this invention is useful in apparatus and processes for separating blood into components thereof in a centrifuge. The invention is particularly suitable for various pheresis processes, such as, (a) plasma-pheresis, wherein whole blood is removed from a donor, separated into cell-free plasma and packed red blood cells followed by reinfusion of the autologous red cells or (b) platelet-pheresis, wherein whole blood is removed from a donor and separated into three components, platelet-rich plasma (PRP), pletelet-poor plasma (PPP) and packed red blood cells (RBC) followed by reuniting the PPP and RBC which are returned to the donor, or similar component separation where the donor donates a unit of blood which is separated into plasma and packed red cells; plasma, platelets and packed red cells; or plasma, platelets, white cells and packed red cells.

For purposes of explanation, the invention will generally be described in connection with component separation of whole blood into plasma, platelets, and packed red cells by centrifugal separation in accordance with the specific gravity of the components.

It is contemplated that a Self-Balancing Centrifuge, or equivalent, will supply the necessary centrifugal force for blood processing in accordance with the invention. It is also contemplated that the separation process will be implemented in accordance with copending U.S. patent application Ser. No. 281,655 filed concurrent herewith, the details of which are at least partially set forth herein for convenience, in explanation of the preferred embodiment.

The invention, however, is not intended to be thereby limited in any way to use of such apparatus or processes.

Figure 1:
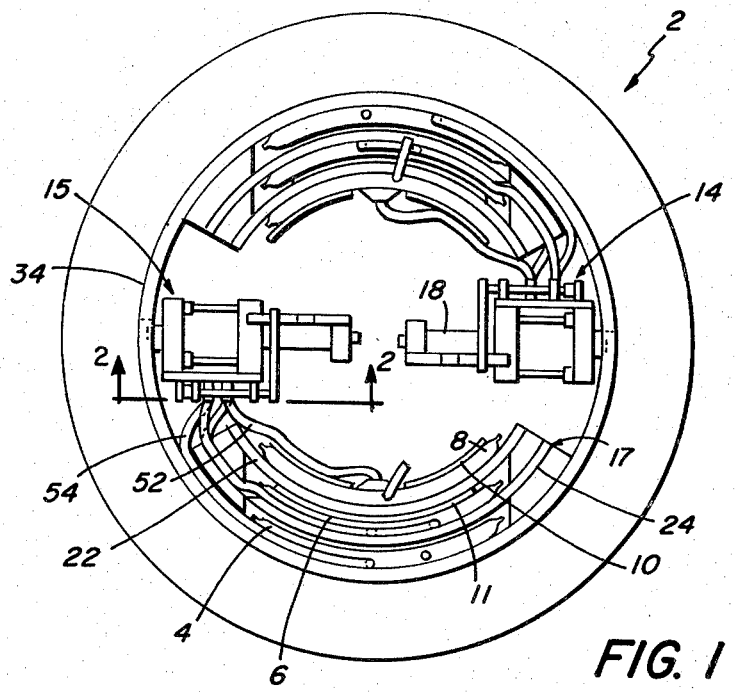
FIG. 1 is a top view of a centrifuge in which the software of the invention may be disposed.

For simplicity, therefore, only a top view of such a Self-Balancing Centrifuge is shown in FIG. 1. The apparatus shown in FIG. 1 is designed to conduct two pheresis processes simultaneously and therefore has duplicate process apparatus within each half of the rotor of centrifuge 2. Rigid cassettes 17 are mounted on opposite sides of the rotor of centrifuge 2 within cylindrical housing 34.

Figure 4:
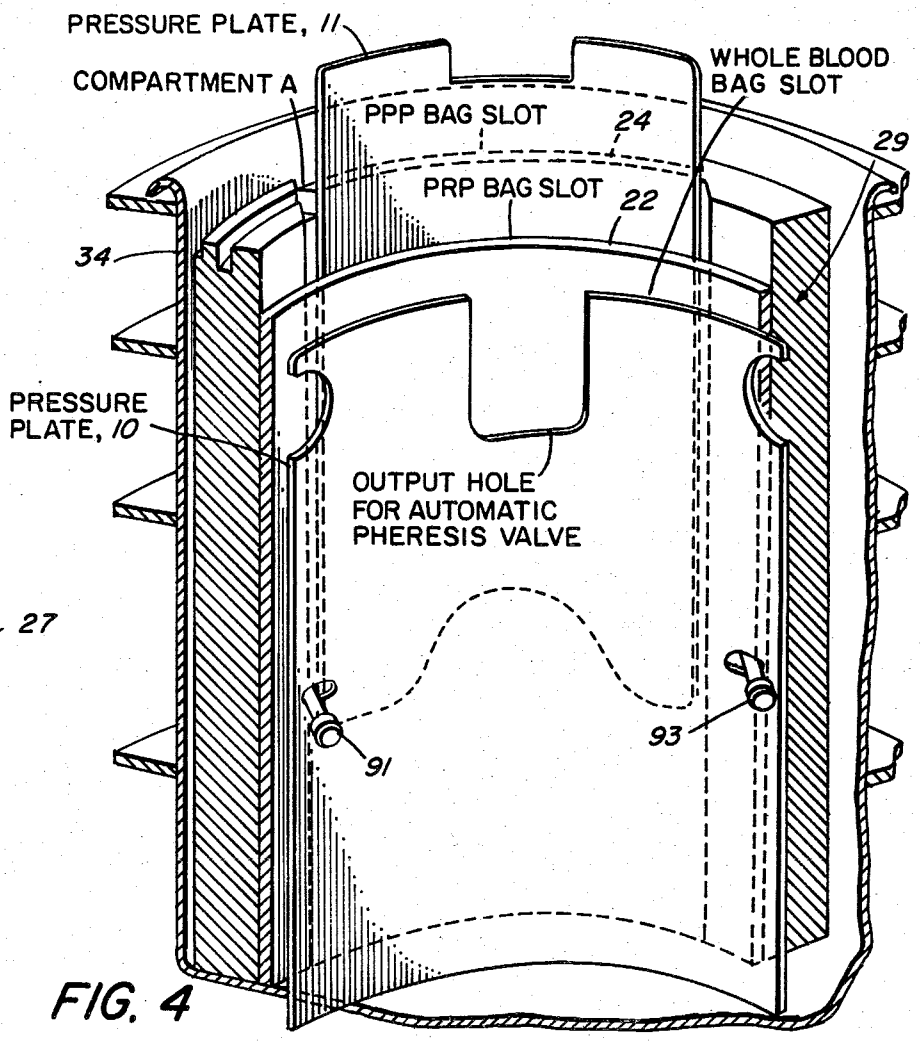
FIG. 4 is an enlarged exploded perspective view of a cassette for use with the invention as mounted in the rotor but without the disposable software set.
Figure 3:
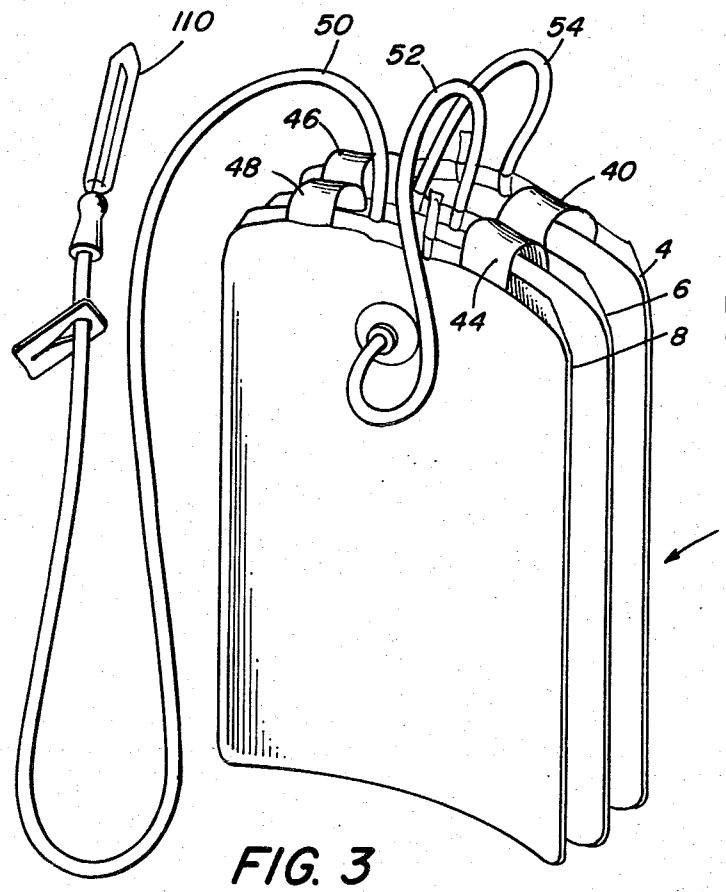
FIG. 3 is a perspective of a disposable software set of the invention.

Each cassette 17 consists of a stand, or rack, which is partitioned into three annular sections by two vertically positioned support members 22 and 24 each having a shape generally described by a segment of a cylinder with a radius corresponding to the radius to the center of rotation of the centrifuge rotor (as shown in detail in FIG. 4).

A sufficient volume of anticoagulant may be initially stored in a whole blood bag 8 or the appropriate anticoagulant ratio may be pumped with the blood as described in copending U.S. patent application Ser. No. 182510 filed Aug. 29, 1980 to Gilcher et al.

After being filled with whole blood, tube 50 is heat sealed close to bag 8 and the section of tubing 50 containing the phlebotomy needle is disconnected and discarded. A pressure plate 10 is suspended adjacent the whole blood bag 8 on two mounting bolts 91 and 93 (shown in FIG. 4) on the side nearest the center of rotation and in such a manner that the plate 10 is free to move or float against the whole blood bag 8 under the influence of centrifugal force when the rotor is spinning. Bag 8 is loaded in the cassette while pressure plate 10 is moved radially inward. This allows sealed bag 8 filled with anticoagulated whole blood to be inserted into the space between the plate 10 and the cassette wall 22. The PRP bag 6 is inserted into the next section of the cassette and the PPP bag 4 in the last section, which is the section furthest removed from the center of rotation.

An additional pressure plate 11 may be provided adjacent the side of the PRP bag 6 nearest the center of rotation. This pressure plate cooperates with a flexible elastomeric gasket to isolate platelets and prevent them from flowing out the PPP tube 54.

The respective tubing 52 and 54 interconnecting the PRP bag 6 with the whole blood bag 8 and the PPP bag 4 with the PRP bag 6 are inserted in respective clamps 31 and 35 of the hydraulic timer mechanism 15.

In operation, the PRP tubing 52 and PPP tubing 54 are initially clamped "off" by operation of the hydraulic timer mechanism 15. The centrifuge 2 is then brought to a suitable speed, for example, 2000 r.p.m., for a sufficient time to allow centrifugal separation of PRP and packed RBC's within bag 8, i.e. about one minute. The hydraulic timer 15 then unclamps the PRP tubing 52 by rotating clamp 31.

The pressure exerted by the weight plate 10 on the whole blood bag 8 as the rotor continues to spin is sufficient to force the plasma separated in bag 8, which is of lower density, out the exit port of the bag and into PRP tubing 52, which is centrally located on the side of the whole blood bag nearest the center of rotation. The weight plate is needed here as initially the PRP must be pushed toward the center of rotation of the rotor as it leaves the blood bag.

Once fluid starts flowing from the whole blood bag 8 to the PRP bag 6 a siphon effect is created, inasmuch as the whole blood bag 8 is located at a shorter radius than the PRP bag and therefore at a higher potential energy.

Under these conditions, once the PRP tubing 52 is filled with fluid, the difference in potential energy from the whole blood bag 8 to the PRP bag 6 favors flow in that direction and pressure from the pressure plate 10 is no longer required to maintain flow. However, the plate still serves a useful function to prevent the buildup of excessive dynamic waves on the inner wall of the blood bag.

This siphon effect is advantageous in that the mass of the pressure plate 10 and the pressure that it generates in the centrifugal force field is minimized. Therefore, the pressure holding capacity of the blood bags is greatly reduced and lower cost disposable plastic bags may be utilized. On the other hand, once initiated, fluid flow will continue, therefore, means are required to automatically stop the flow of plasma before any RBC is lost.

Figure 6:
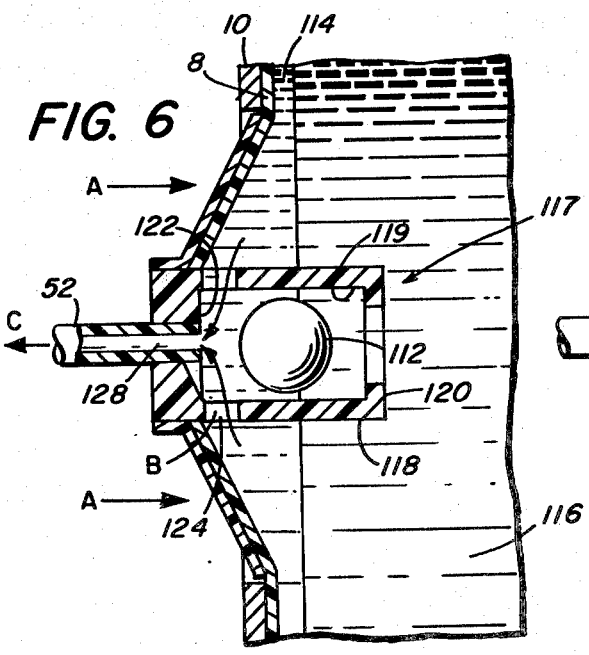
FIG. 6 is a partial cross-section along the lines 6—6 of FIG. 5 showing the details of the automatic pheresis valve of the invention.

In the preferred embodiment shown in FIG. 6 of the invention, this automatic flow control means (shown generally at 117) is provided by a Pheresis Valve with a ball stopper 112 having a specific gravity greater than PRP (about 1.03) but less than that of packed cells (about 1.10). This ball stopper is located in the whole blood bag 8 so as to float on top of the packed RBC layer 116. A separated first blood component, such as plasma layer 114, occupies the radially inner portion of the flexible blood-processing bag 8 whereas separated second blood component such as RBC layer 116, occupies the radially outward portion. As illustrated, the pressure plate 10 applies a force in the radially outward direction (arrows A) which tends to collapse the flexible blood processing bag 8 and expel first blood component (plasma layer) 114 therefrom.

The stopper ball 112 is contained within a guide member 119 formed by a cylindrical wall member 118, an end wall member 120, and a stopper ball seat 122. The cylindrical wall member 118 has one or more input ports 124 located relatively close to the stopper ball seat 122. Separated first blood component (PRP) enter the input port(s) (as shown by arrows B) in the cylindrical wall member 118 and leave the flexible blood bag 8 and flow through output port 128 into tubing 52 in the direction of arrow C to PRP bag 6.

The inner diameter of the cylindrical wall member 118 is chosen such that the stopper ball is free to move axially within guide 119 in the direction C, but not radially. The end wall member contains one or more end wall ports 124. When the depth of the first blood componant 114 is greater than the depth of the end wall member within the flexible blood processing bag 8, the stopper ball 112 rides on top of, and is supported by, the end wall member.

Figure 7:
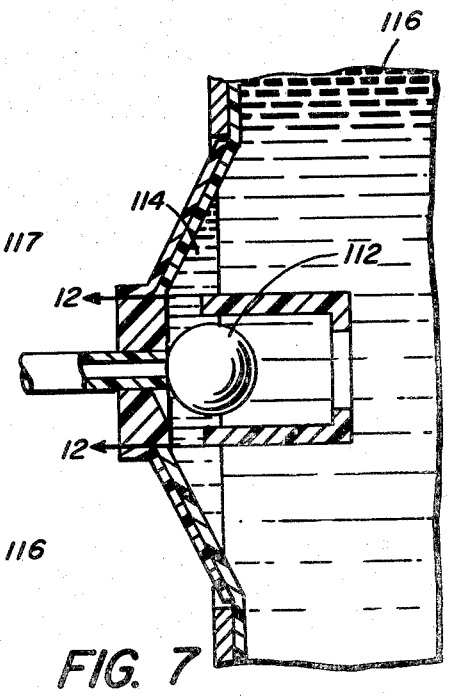
FIG. 7 is a further cross-sectional detail showing the valve of FIG. 6 in the closed position.

As the first blood component 114 is expressed from the flexible blood processing bag 8 by the force of pressure plate 10 moving in the direction A the interface between said first and second components approaches the output port 128, of the flexible whole blood bag 8. The stopper ball 112 also approaches the output port 128. Eventually, the stopper ball 112 is carried into contact with the seat of guide 119 and forms a seal with the port. This is illustrated in FIG. 7 wherein substantially all of the first blood component 114 has been expelled from the flexible whole blood bag 8 and all that remains is second blood component 116. When the stopper ball 112 comes into contact with the outlet port, flow is thus immediately halted automatically.

As previously noted, the specific gravity of the stopper ball 112 is chosen so that it floats on the interface between the first and second blood components 114 and 116. That is, the stopper ball 112 has a specific gravity greater than the specific gravity of the second blood component 116. For example, if the first blood component is plasma which has a specific gravity of about 1.03, and the second blood component comprises mostly RBC which has a specific gravity of about 1.10, the specfic gravity of the stopper ball 112 is preferably chosen to be about midway between these values. Typical materials for the ball stopper is Dow Corning silicone which comes in specific gravities within this range and can be supplied with FDA Class VI certification, or conventional polystyrene.

While the embodiments thus far described have operated on the principle that the blood component with the greater density, for example RBC, is retained in the container and the less dense component PRP is allowed to flow to another container, in some applications it may be desirable to reverse the process. For example, if the outlet port and valve seat is located adjacent the more dense component and a ball float with an intermediate density is disposed to float on the interface, as the more dense component is expressed out the port the interface and ball would move toward the valve seat and close in the manner previously described.

It should be noted that if air bubbles accumulate in any sections of the PRP tubing 52 which are extending radially toward the center of rotation (increasing in radius from the whole blood bag (8) a vapor lock may occur in the line. In the embodiment thus far described, the pressure required to initiate the flow of plasma 114 from the whole blood bag 8 to the PRP Bag 6 through tubing 52 is developed by the centrifugal force on pressure plate 10. Once the flow of plasma has begun and the PRP tubing 52 is full, the siphon effect previously described dominates the flow. This is one of the advantages of the inner/outer bag geometry of this first embodiment. High flow rates can be reached without the need for a heavy pressure plate 10. On the other hand, if a vapor lock occurs in tube 52 flow will either be diminished or stopped completely. Since the introduction of air in small quantities into the software set is probably unavoidable, a solution to this problem is imperative.

Figure 2:
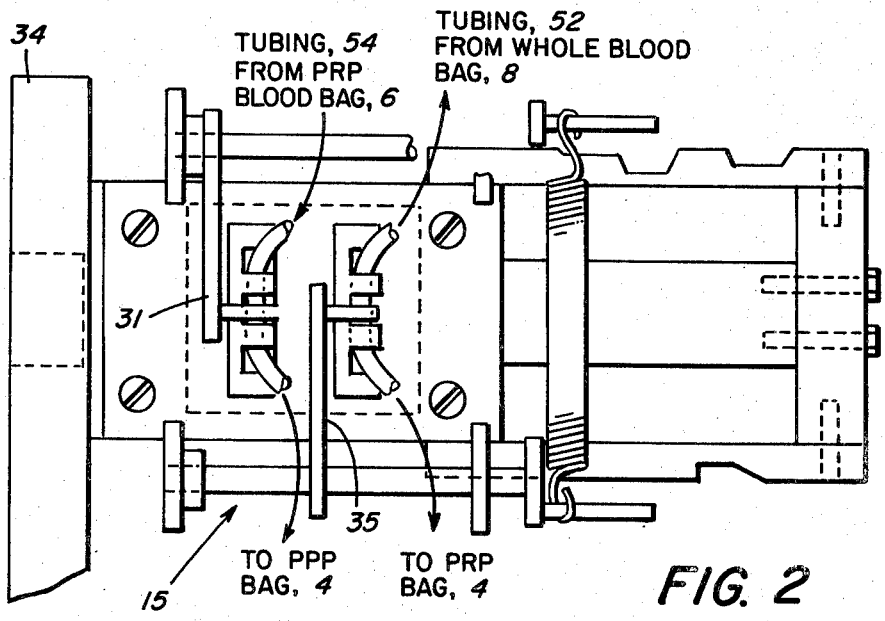
FIG. 2 is a partial side view of a hydraulic timer clamp for use within the invention.
Figure 5:
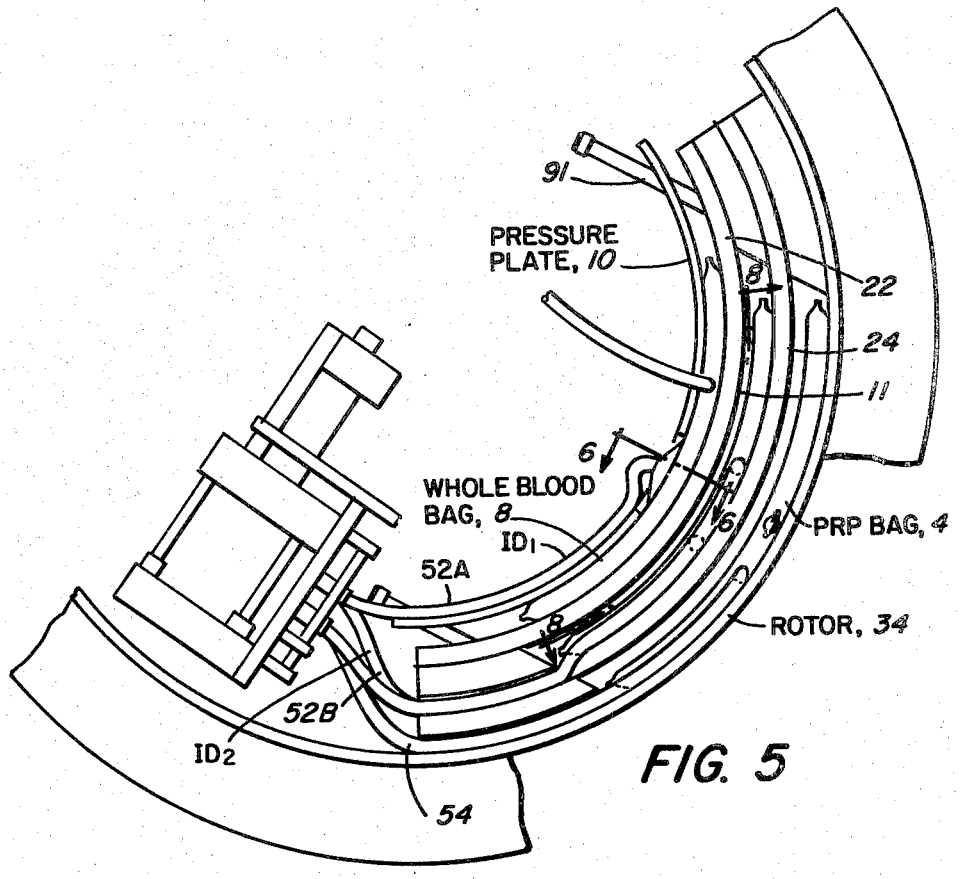
FIG. 5 is a diagrammatic sectional illustration of the details of the cassette and software set of FIG. 1 interconnected with the hydraulic timer mechanism of FIG. 2.

In the embodiment shown in FIGS. 2 and 5, a simple and inexpensive solution is illustrated. As shown in FIG. 5, the output port for tubing 52 on whole blood bag 8 is oriented by pressure plate 10 to be at a minimum radius with respect to the radius of the bag 8 from the center of rotation. Thus, any air in the bag 8 will collect in the area of the output port. When tubing 52 is unclamped by clamp 31 of mechanism 15, this air must flow out of the bag 8 and into the PRP bag 6 before any plasma will flow.

As indicated in FIG. 5, the section of tubing labeled 52B has an unusually small internal diameter, $ID_2$ as compared to a normal inner diameter $ID_1$ on the remaining section 52A of tubing 52. Section 52B is the section of tubing which extends radially outward from the bag 8 to the clamp 15 and therefore fluid in this section is in effect forced to flow downhill with the centrifugal force. With the internal diameter reduced in this section, the velocity of flow increases and air bubbles which would otherwise be trapped in this section are forced to flow "down" the tube 52 to PRP bag 6.

Figure 8:
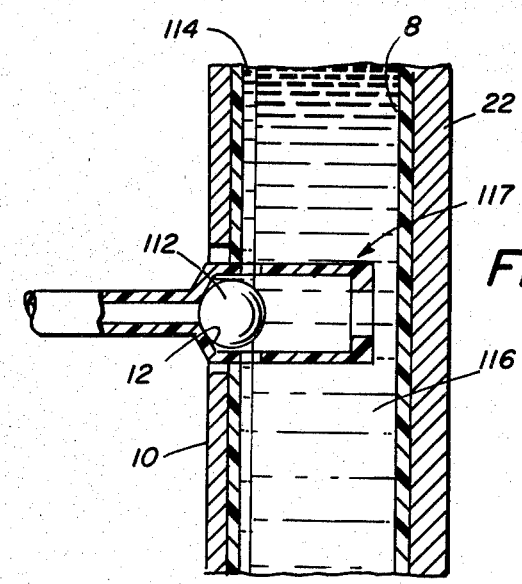
FIG. 8 is a partial cross-section similar to FIG. 6 showing the details of a pheresis valve having a large diameter ball stopper.
Figure 9:
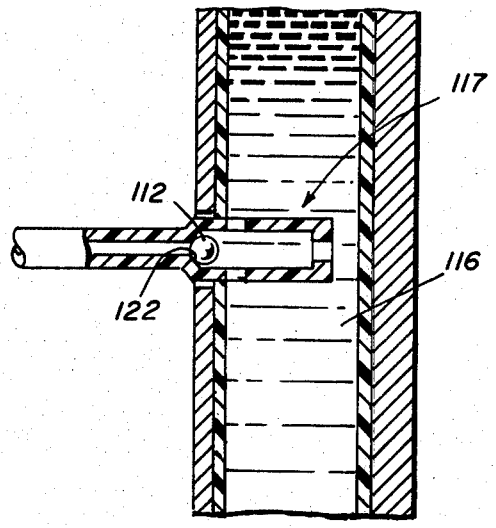
FIG. 9 is a cross-section similar to FIG. 7 showing a pheresis valve with a small diameter ball stopper.

Referring now to FIGS. 8 and 9 (in which the numbers used are the same for parts corresponding to parts previously described in connection with FIG. 6) the effect of the size of the stopper ball 112 on the precise blood cut achieved is illustrated. In FIG. 8, the ball stopper 112 has a relatively large diameter and tends to contact and seal outlet port 128 prior to the expulsion of all the first blood component 114. If the first blood component 114 is plasma and the second blood component 116 is packed red cells, the effect of the larger diameter ball stopper 112 is to lower the hematocrit of the second blood component remaining in the blood processing bag 8. On the other hand, when a relatively smaller diameter ball stopper is employed, such as in FIG. 9, a much smaller amount of PRP 114 remains in the flexible blood processing bag 8. Thus, the hematocrit of the second blood component or packed red cells 116 is raised.

Figure 10:
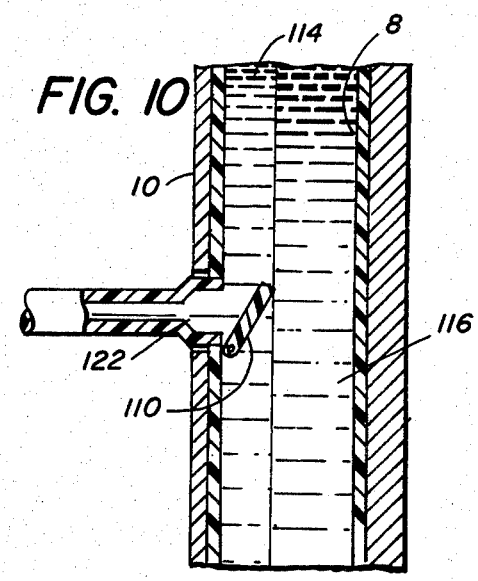
FIG. 10 is a cross-sectional detail of a pheresis valve using a flap valve instead of a ball valve.

FIG. 10 shows an alternative embodiment of a Pheresis Valve for sealing the outlet port of a flexible blood processing pouch. In this embodiment, a hinged flap 110 has one end joined to an interior surface of the flexible blood-processing bag 8 at a position adjacent to the outlet port 128. The hinged flap 110 is of a density similar to that of the stopper ball 112 and operates in a manner similar to the stopper ball 112 previously described in that it floats at the interface between first blood component 114 and second blood component 116. Thus, as this interface approaches the outlet port, the hinged flap is carried into contact with the outlet port 128 thereby creating the required seal.

In some applications of the invention, such as cell washing or gaining maximum plasma yield, it is desirable to be able to re-open the Pheresis Valve 117 after it closes. In the embodiments heretofore described, once the valve closes, it is prevented from re-opening by the high negative pressure of the fluid downstream (in the direction C of FIG. 6) from the valve.

One way to make the valve re-open is to minimize the negative pressure force in the direction C of FIG. 6 and maximize the positive buoyancy force in the opposite direction created by the volume of fluid left in the bag 8. This could be accomplished by decreasing the cross-sectional area of the output tube 52 and increasing the size and therefore the buoyant volume of the valve float. The latter is undesirable since it increases the manufacturing cost of the bag and the former increases the disruptive shear stresses of blood components flowing through the valve, thereby increasing the probability of occlusions.

Figure 11:
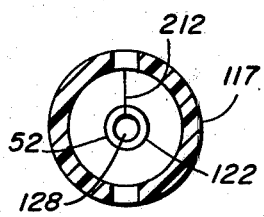
FIG. 11 is a sectional view showing the valve seat details of the ball valve taken along lines 12—12 of FIG. 7.

A better solution to this problem is shown in FIG. 11 which is a cross-sectional view taken along the lines 12—12 of FIG. 7. As shown in FIG. 11, the valve seat 122 is made leaky by one or more tiny slots 212 on the valve seat 122 so that the negative downstream pressure is dissipated. The slots leak about 1 milliliter per minute when the ball valve is seated.

The operation of the slotted valve may be described as follows in connection with FIGS. 8 and 11:

First, the ball stopper 112 approaches the valve seat 122 as it floats on the interface between RBC 116 and plasma 114. Eventually, the ball stopper 112 lodges in the valve seat and cuts off the flow of plasma 114 through PRP tubing 52. As the centrifuge continues to spin, more plasma 114 is separated from whole blood and the interface between plasma and RBC moves away from the valve seat. At the same time, some of the plasma 114 leaks through the slits 212 into the output tube 52 dissipating the negative pressure on that side of the ball stopper. At some point, the buoyancy force on the stopper 112 becomes greater than the negative pressure in the tube 52 and the valve mechanism 117 reopens allowing the flow of plasma to resume. The apparatus may be permitted to re-cycle as described above until substantially all the plasma is separated from the whole blood.

Equivalents

Those skilled in the art may recognize other equivalents to the specific embodiments described herein, which equivalents are intended to be encompassed by the claims attached hereto.

I claim:

1. Apparatus for use in the centrifugal separation of blood into at least a first blood component and a second blood component, comprising, in combination:
   a. a flexible blood processing bag having an inlet port and an outlet port;
   b. blood-compatible tubing providing fluid communication between the inlet port of said flexible blood processing bag and connection means for connecting said blood compatible tubing to a source of blood to be separated;
   c. a receiver-container for receiving first blood component separated in said flexible blood processing bag;
   d. blood-compatible tubing providing a fluid communication path between the outlet port of said flexible blood processing bag and said receiver container; and
   e. valve means for preventing fluid communication between said flexible blood processing bag and said receiver container in response to the difference between the specific gravities of separated first and second blood components.

2. The apparatus of claim 1 wherein said valve means comprises a stopper having a specific gravity which is higher than the specific gravity of first blood component but lower than the specific gravity of second blood component.

3. The apparatus of claim 2 wherein said stopper is contained within a guide located at the outlet port of said flexible blood processing bag.

4. The apparatus of claim 3 wherein said guide includes means for preventing sealing of said outlet port caused by the flow of first blood component through said port.

5. The apparatus of claim 4 wherein said means for preventing sealing comprise flow passages in said guide located between said outlet port and the normal resting position of said stopper.

6. The apparatus of claim 2 wherein said stopper prises a flap connected to the interior surface of said flexible blood processing bag adjacent to said outlet port.

7. The apparatus of claim 2 wherein said stopper comprises a ball.

8. The apparatus of claim 1 wherein said receiver container comprises a flexible blood processing bag whereby said second blood component can be further separated therein.

9. The apparatus of claim 8 wherein said receiver container has an outlet port connected to an additional receiver container.

10. The apparatus of claim 1 in which the valve has a slotted valve seat to permit a slow flow of fluid across the valve even when the body is seated.

11. Apparatus comprising:
   a. a flexible blood processing bag having an output port and adapted to contain anticoagulated whole blood;
   b. a receiving container having an input port and adapted to receive a component of said whole blood;
   c. tubing means providing fluid communication between the output port of the bag and the input port of the receiving container; and
   d. valve means for terminating flow of fluid component out the output port of the bag in response to the specific gravity of said component.

12. The apparatus of claim 11 in which the valve means is located at the output port of the bag.

13. The apparatus of claim 11 in which the valve means comprises a float stopper having a specific gravity intermediate the specific gravity component flowing to the receiver container and the remaining components.

14. The apparatus of claim 11 in which the container is also flexible and has an output port.

15. The apparatus of claim 11 in which the valve means includes flow means for permitting flow to resume at a much slower rate.

16. The apparatus of claim 14 including an additional container having an input port and adapted to receive a fluid component of the component in the first recited container.

17. In a process wherein blood is separated into a first blood component and second blood component in a blood processing chamber and first blood component is thereafter caused to flow through an outlet port of said chamber through a conduit and into a receiver container:

The improvement of stopping flow to the container by a valve means having a stopper with a specific gravity which allows it to float on the interface between first and second blood components within said chamber.

18. The improvement of claim 17 in which the chamber comprises a flexible bag.

19. The improvement of claim 17 in which the valve means is located in the chamber adjacent the outlet port.

20. The improvement of claim 17 in which the conduit between said chamber and container has an inner diameter sufficiently small to cause the second blood component to achieve a flow velocity which will cause any air bubbles in the conduit to flow to said container.

21. The improvement of claim 17 in which the first blood component is plasma and the second component is red blood cells.

22. A method comprising:
   (a) rotating a volume of whole blood contained in a first container in a centrifuge at a speed sufficient to separate said whole blood into at least two components, a less dense and more dense component;
   (b) forcing one of the components to flow from said bag to a second container while said volume is being rotated;
   (c) preventing the flow in step (b) until substantial separation occurs in step (a) and;
   (d) causing said flow to stop by control means in the centrifuge when substantially all of the component in step (b) has flowed from the bag.

23. The method of claim 22 in which the flow is stopped in step (d) by control means responsive to the density of one of said components.

24. The method of claim 23 in which the component flowing in step (b) is the less dense component.

25. The method of claim 23 in which the component flowing in step (b) is the more dense component.

* * * * *